US006495303B1

(12) United States Patent
Kanda et al.

(10) Patent No.: US 6,495,303 B1
(45) Date of Patent: Dec. 17, 2002

(54) PROCESS OF PRODUCING POLYMERIZED TONER

(75) Inventors: Hitoshi Kanda, Yokohama (JP); Takeshi Naka, Shizuoka-ken (JP); Hiroshi Koyama, Yokohama (JP); Yoshinori Tsuji, Shizuoka-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/699,500

(22) Filed: Oct. 31, 2000

(30) Foreign Application Priority Data

Nov. 1, 1999 (JP) ..... 11-310588
Oct. 25, 2000 (JP) ..... 2000-325955

(51) Int. Cl.[7] ..... G03G 9/08
(52) U.S. Cl. ..... 430/137.17
(58) Field of Search ..... 430/137, 137.17, 430/137.19; 528/502 A, 502 D; 210/781, 787, 803, 374; 494/53

(56) References Cited

U.S. PATENT DOCUMENTS

| | | | | |
|---|---|---|---|---|
| 3,988,235 A | | 10/1976 | Shibata et al. | 204/266 |
| 5,087,546 A | | 2/1992 | Kanda et al. | 430/137 |
| 5,712,072 A | * | 1/1998 | Inaba et al. | 430/137 |
| 5,856,056 A | | 1/1999 | Omata et al. | 430/137 |
| 5,865,381 A | | 2/1999 | Mitsumura et al. | 241/18 |
| 6,309,788 B1 | * | 10/2001 | Tsuji et al. | 430/137.17 |

FOREIGN PATENT DOCUMENTS

| | | | |
|---|---|---|---|
| JP | 10231 | | 7/1961 |
| JP | 10799 | | 5/1968 |
| JP | 14895 | | 2/1976 |
| JP | 58-158650 | * | 9/1983 |
| JP | 160661 | | 6/1995 |
| JP | 8-137131 | * | 5/1996 |

OTHER PUBLICATIONS

Derwent Machine–Assisted Translation of JP 8–137131–A (Pub 5/96).
U.S. Patent & Trademark Office English–Language Translation of JP 58–158650 (Pub 9/83).
Japanese Patent Office Machine Translation of JP 8–137131 (Pub 5/96).*
JPAB Abstract of JP 58–158650, Sep. 1983.*
Caplus Abstract AN 1984: 219012 Describing JP 58–158650.*
Lee et al., "The Glass Transition Temperature of Polymers", Polymer Handbook (III–139) to (III–192), published by Wiley Interscience in 1973.
U.S. patent application Ser. No. 09/433,559, Yoshinori Tsuji, filed Nov. 4, 1999.
Patent Abstracts of Japan, 1996, 09, Sep. 30, 1996 for JP8–137131.
Database WPI, Sect. Ch, Week 199230, Derwent Publ., AN1992–246545, XP 2158651 (1992).
Patent Abstracts of Japan, 009, 190, Aug. 7, 1985 for JP 60–057855.
Database WPI, Sect. Ch, Week 199129, Derwent Publ., AN 1991–212627, XP002158652.

* cited by examiner

*Primary Examiner*—Janis L. Dote
(74) *Attorney, Agent, or Firm*—Fitzpatrick, Cella, Harper & Scinto

(57) ABSTRACT

A process for producing polymerized toner comprises polymerizing a composition containing a polymerizable monomer and a colorant in a medium to form colored resin particles, separating the particles from the medium by filtration, and drying the separated particles. The separation of the particles from the medium is effected by a decanter-type centrifugal separator equipped with an outer rotary cylinder which contains a screw conveyor freely rotating relative to the cylinder.

7 Claims, 3 Drawing Sheets

PROCESS OF PRODUCING POLYMERIZED TONER

BACKGROUND OF THE INVENTION

1. Field of the Invention

The present invention relates to a process of producing a polymerized toner for various recording method, e.g., electrophotography, electrostatic recording and toner-jet recording.

2. Related Background Art

A number of electrophotographic methods are known. In general, they use a photoconductive material to form an electrical latent image on a photosensitive member by various methods, develop the latent image with a toner to make it visible, transfer the toner image to a transfer medium, e.g., paper, as necessary, and fix the toner image on the transfer medium by the aid of heat, pressure or the like to produce the copy or print.

Various methods have been also proposed for developing images by the aid of toner, and fixing toner images.

The conventional processes to produce the toner for the above purposes generally involve uniform dispersion of a colorant, e.g., dye or pigment, in a thermoplastic resin by melting/kneading, finely divide it by a milling machine or the like, and classify the above particles by a classifier to have the toner of desired particle size.

These processes can produce the toner of fairly high quality, but have several limitations, e.g., limitation of the toner materials. For example, the resin dispersed with the colorant should be sufficiently fragile to be finely divided by an economically viable machine system. When the resin is sufficiently fragile to satisfy the above requirements, the fine particles prepared by a high-speed milling machine tend to have a broad size range, into which the fine particles fall at a relatively high proportion. Moreover, the toner of such a fragile material tends to be further divided or powdered in a developing device, e.g., copier. Another problem involved in this process is difficulty in dispersing the fine solid particles (e.g., of colorant) in the resin, which may deteriorate image quality, depending on extent of the dispersion, resulting in, e.g., increased fogging, decreased image concentration, mixed colors, and insufficient transparency. Therefore, care must be fully taken to well disperse the colorant. Moreover, exposure of the colorant to the fractured planes of the milled particles may fluctuate the developing characteristics.

In order to solve the problems involved in the milled toners, various toners and processes of their production have been proposed. For example, Japanese Patent Publication Nos. 36-10231 and 43-10799 disclose various types of polymerized toners, including suspension-polymerized toners, and their production processes.

For example, the suspension polymerization for producing the toner includes preparing a uniformly dispersed or dissolved monomer composition comprising a polymerizable monomer, colorant, polymerization initiator, and, as required, crosslinking agent, charge-controlling agent and one or more other additives; dispersing the monomer composition in a medium containing a dispersion stabilizer, e.g., an aqueous phase, using an adequate agitator; and, at the same time, polymerizing the composition, to produce the toner particles of desired size. This process has various advantages. For example, the toner particles are not necessarily fragile, because no milling step is involved, and soft resin may be used. No colorant is exposed to the particle surfaces, and the toner of uniform friction-induced charging characteristics can be produced. The toner thus produced has a relatively sharp particle size distribution, needing no classification step or classification to only a slight degree, to increase toner yield.

However, the suspension polymerization directly produces the toner in a medium, thus needing a step of separating the toner particles from the medium. Japanese Patent Application Laid-Open No. 8-160661 discloses a polymerized toner and process of producing the same, proposing dehydration and washing steps by a continuous belt filter and siphon type centrifuge. These devices can separate the polymerized toner by filtration. However, they are very large, and, using a filter, involve the problems associated with clogging of the filter. As a result, the through-put may be reduced, when the filter is used repeatedly. No filtration is effected, when the filter is completely clogged, thus a step of washing the filter is needed. It is essential, therefore, to prepare an excess quantity of wash water or spare filter, which pushes up the cost.

Emulsion agglomeration also needs separation of the toner particles from the medium, when used for producing the toner, sharing the common problems with suspension polymerization.

SUMMARY OF THE INVENTION

It is an object of the present invention to provide a process of producing polymerized toner which efficiently separates the polymerized toner particles from the medium by filtration.

It is another object of the present invention to provide a process of producing polymerized toner which satisfactorily removes the dispersion stabilizer from the toner particles.

The process of the present invention produces a polymerized toner by polymerizing a polymerizable monomer composition comprising a polymerizable monomer and colorant in a medium to produce the colored resin particles, separating the colored resin particles from the medium by filtration, and drying them, wherein the filtration is effected by a decanter type centrifugal separator equipped with an outer rotary cylinder which contains a screw conveyor freely rotating relative to the cylinder.

DETAILED DESCRIPTION OF THE PREFERRED EMBODIMENTS

Now, the present invention will be described in detail.

The process of the present invention produces a polymerized toner by polymerizing a polymerizable monomer composition comprising at least a polymerizable monomer and colorant in a medium to produce the colored resin particles, separating the colored resin particles from the medium by filtration, and drying them, wherein the filtration is effected by a decanter type centrifugal separator equipped with an outer rotary cylinder which contains a screw conveyor freely rotating relative to the cylinder. The colored resin particles may be removed by at least 2 types of filter units, at least one of them being a decanter type centrifugal separator equipped with an outer rotary cylinder which contains a screw conveyor freely rotating relative to the cylinder.

The methods of removing solid particles from a slurry generally fall mainly into vacuum, centrifugal and pressurized filtration. The inventors of the present invention have found that, of these filtration types, the decanter method as one of the centrifugal separation method is suited for the present invention. They have also found that a combination of two or more filter units is more suited for production of the polymerized toner.

Vacuum and pressurized filtration methods, although excellent, indispensably need a filter, e.g., cloth or paper, and invariably involve decreased efficiency resulting from clogging of the filter. Washing the filter cloth or paper is effective for solving the clogging problems, but needs a large quantity of wash water to push up cost, as discussed earlier.

Centrifugal separation should have the similar problems, so long as it uses a filter cloth.

These methods are generally batch type, and hence low in productivity and unsuited for massive treatment. The continuous method is also proposed, but it needs a large installation area and hence huge investment.

By contrast, the process of the present invention is free of these problems, because the decanter type separation method therefor uses no filter. The process of the present invention for producing toner can be operated continuously and reduce required plot area, and hence is very high in efficiency.

Figure 1:
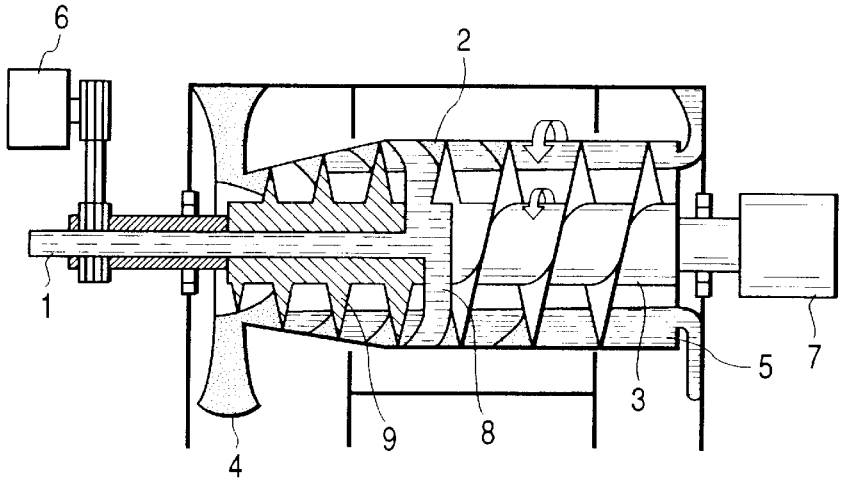
FIG. 1 schematically illustrates the sectional view of a decanter type centrifugal separator suitably used for the present invention.
Figure 2:
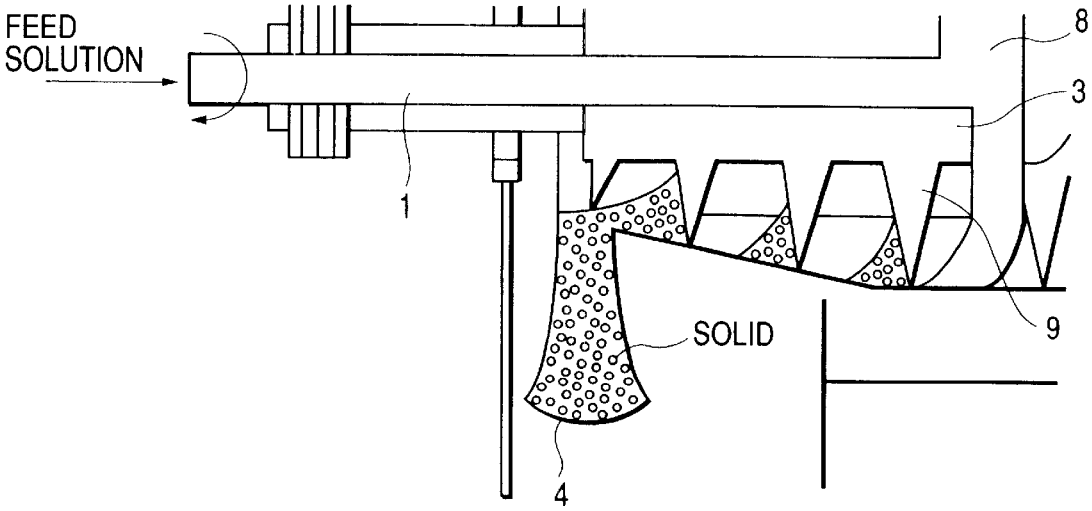
FIG. 2 is a part of the magnified view of the section shown in FIG. 1.

The present invention will be described in more detail by referring to the drawings. FIG. 1 schematically illustrates the sectional view of a decanter type centrifugal separator suitably used for the present invention, and FIG. 2 is a part of the magnified view of the section shown in FIG. 1, wherein reference numeral 1 denotes feed tube, reference numeral 2 outer rotary cylinder, reference numeral 3 screw conveyor, reference numeral 4 solid discharge port, reference numeral 5 dam plate, reference numeral 6 driving motor, reference numeral 7 gearbox, reference numeral 8 supply port, and reference numeral 9 screw blade. The left half of FIG. 1 illustrates the sectional view.

This separator supplies the feed solution to be filtered to the outer rotary cylinder 2 via the feed tube 1 in the screw conveyor 3. When the rotary cylinder 2 is rotated at a high speed to give a high centrifugal force to the feed solution, the solids are settled on the inner walls of the cylinder 2. These separated solids are scraped up by the blade 9 of the screw conveyor 3, rotating concentrically with the outer rotary cylinder 2 at a slightly different speed, and subsequently moved toward the solid discharge port 4, from which they are discharged. The liquid separated from the solids is discharged from the separator after flowing over the dam plate 5, which adjusts the liquid level.

The differential rotational speed between the outer rotary cylinder 2 and screw conveyor 3 may be set at an adequate level, preferably 5 to 30 rpm for the present invention.

The dam plate 5 for adjusting the separated liquid level may be adjusted adequately according to the filtration-related properties of the feed solution.

The clearance between the inner wall of the outer rotary cylinder 2 and screw conveyor 3 may be set at an adequate level, preferably at 1 to 5 mm, more preferably 1 to 2 mm, viewed from the discharge-related properties of the solids. The clearance beyond the above range is undesirable; the solids tend to remain excessively in the separator at above 5 mm, whereas they may be damaged at below 1 mm.

The centrifugal force G produced by the outer rotary cylinder rotating at a high speed may be set adequately by controlling the rotational speed, preferably 1,000 to 5,000 G, more preferably 1,500 to 4,000 G for the present invention. The centrifugal force beyond the above range is undesirable. At below 1,000 G, separation between the medium and solids may be insufficient; taking water as the medium, for example, the solids contain too much water as a result of inefficient separation. At above 5,000 G, on the other hand, the solids may be damaged, e.g., by cracking or crushing, although filtration efficiency itself is improved. Separation at a centrifugal force G in the above range is very desirable, because the solids can be left undamaged, while the filtration efficiency is kept at a desired level.

In the process of the present invention, the solids separated from the medium are continuously scraped off and discharged by the screw blade. They are not in the form of cake, and can be directly sent to the subsequent step, e.g., drying step, to improve efficiency. By contrast, the pressurized or vacuum filtration used for the conventional process discharges the solid in the form of cake, which means that an additional step to break up the cake is needed, thus complicating the process.

Production of the toner by the suspension polymerization of the present invention is described more concretely.

A monomer composition, comprising at least a polymerizable monomer, colorant, and, as required, one or more additives (e.g., releasing agent of a compound of low softening point, charge-controlling agent and polymerization initiator) is uniformly dissolved or dispersed by the aid of an adequate device (e.g., homogenizer or ultrasonic dispersion machine), and dispersed in a medium containing a dispersion stabilizer, e.g., water, using a common agitator, homomixer, homogenizer or the like.

It is generally preferable to use 100 to 2,000 parts by weight of a medium as the dispersion medium per 100 parts by weight of the monomer composition in the suspension polymerization.

It is also preferable to granulate the monomer composition under the conditions (e.g., agitation speed and time) controlled in such a way that the droplets of the monomer composition have a desired toner particle size. The particles thus produced are then agitated to an extent to keep the particle conditions by the effect of a dispersion stabilizer and prevent their settlement.

The polymerization is effected at 40° C. or higher, normally 50 to 90° C. Temperature may be increased during the latter half of the polymerization step. In addition, the aqueous medium may be partly distilled off during the latter half or on completion of the polymerization step, to remove, e.g., the unreacted polymerizable monomer and by-products.

Figure 3:
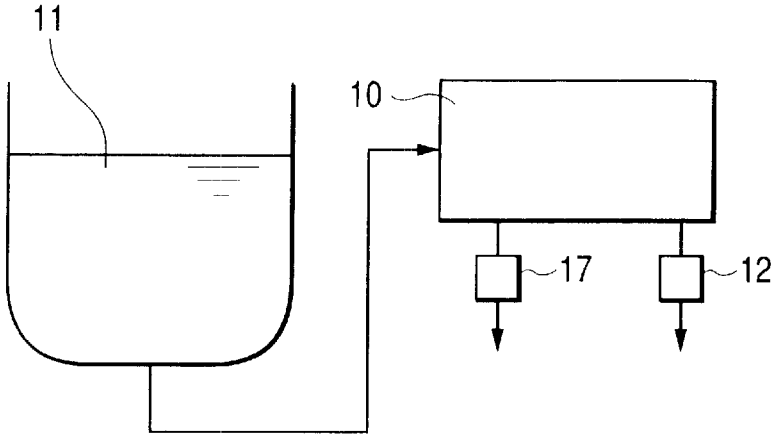
FIG. 3 illustrates a flow diagram of the toner production units suitably used for the present invention.

On completion of the reaction step, pH of the effluent is adjusted, and the dispersion stabilizer is dissolved. The toner particles thus produced are washed, recovered by filtration, and dried. The above-described filtration method is used for filtering the particles. FIG. 3 illustrates a flow diagram of the toner filter units suitably used for the present invention, where reference numeral 10 denotes decanter type centrifugal separator, reference numeral 11 slurry suspension (filtration feed solution), reference numeral 17 wet polymerized toner, and reference numeral 12 aqueous medium filtrate. The filtration flow is described in detail.

Referring to FIG. 3, the slurry suspension 11 dissolving a dispersion stabilizer is sent by a liquid-pumping means, e.g., pump (not shown) to the decanter type centrifugal separator 10, where the solid/liquid separation is effected to separate the slurry suspension 11 into the wet polymerized toner 17 and medium filtrate 12. The wet toner 17 is broken by the blade, discharged from the decanter type centrifugal separator 10, and sent to the subsequent step, e.g., drying step. It is important to remove the dispersion stabilizer from the suspension-polymerized toner, because the dispersion stabilizer used for suspension polymerization generally deteriorates charging characteristics of the toner significantly. Insufficient removal of the stabilizer may cause various problems, e.g., decreased image concentration and fogging, especially under high humidity conditions which inhibit the toner charging.

For removal of the dispersion stabilizer, the medium is generally incorporated with an acid or alkali, depending on stabilizer type, to dissolve the stabilizer therein, and then subjected to the filtration for solid/liquid separation. The medium, which dissolves the stabilizer, remains on the filtration-separated toner surfaces to some extent. When this toner is dried, the medium is removed to leave behind the stabilizer, which is concentrated on the toner particle surfaces. It is also important, therefore, to decrease concentration of the dispersion stabilizer in the medium attaching to the filtration-separated toner surfaces.

One of the methods to decrease concentration of the dispersion stabilizer in the medium is to wash the filtration-separated wet toner with a wash fluid, e.g., water, and refilter out the toner after decreasing concentration of the stabilizer in the wash fluid, to decrease quantity of the stabilizer in the wash fluid attaching to the toner surfaces. It is possible to decrease the concentration to an acceptable level or less by repeating the washing/filtration cycles 2 or more times, as required.

The filter unit for filtration of the suspension is preferably provided with a washing function for the present invention, viewed from investment cost and installation area. Such filter units include filter press and belt filter disclosed by Japanese Patent Application Laid-Open No. 8-160661. These units, however, cannot mix and agitate the wash medium and toner, because the toner is in the form of cake when the wash medium is added. As a result, the toner is washed unevenly to deteriorate its charging characteristics. Therefore, improvement of the filtration/washing methods has been demanded to meet the quality requirements of today's toner markets so that toner should exhibit a high level of durability and enables extremely sharp images to be formed.

The decanter type centrifugal separator for the present invention, containing a screw unit, produces the wet toner which is well washed with a wash medium, because it is not solidified into cake.

Figure 4:
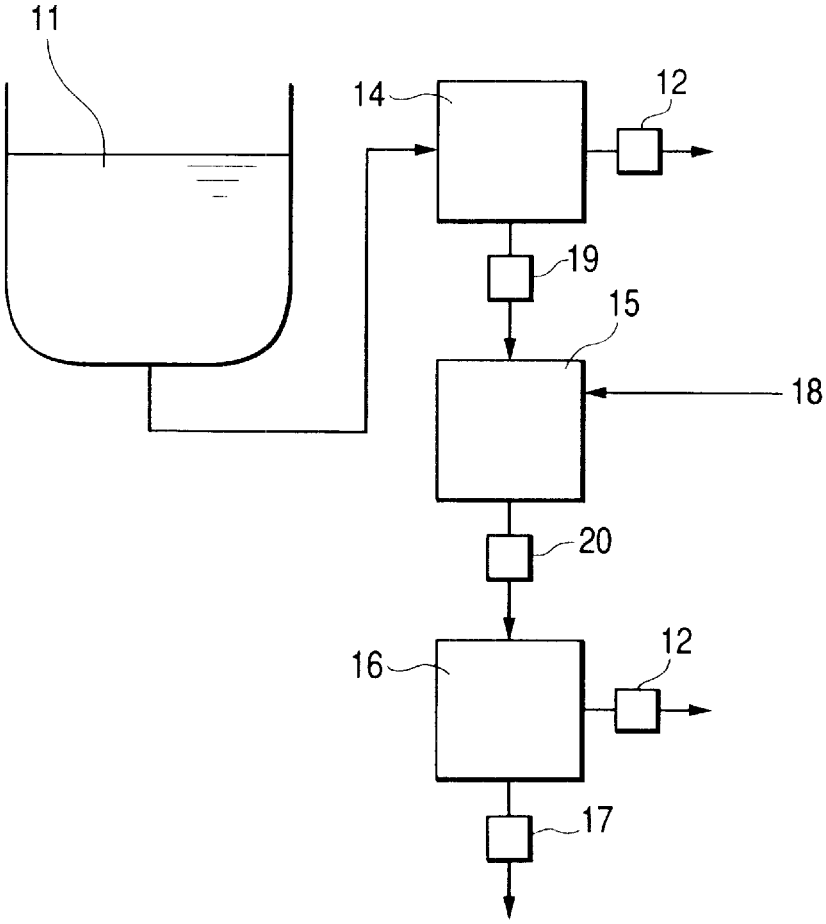
FIG. 4 illustrates another flow diagram of the toner production units suitably used for the present invention.

Use of at least 2 filter units with a washing step in-between is preferable for the process of the present invention, in order to efficiently remove the dispersion stabilizer. FIG. 4 illustrates another flow diagram of the toner production units, including 2 filter units, where reference numeral 11 denotes slurry suspension, reference numeral 14 first filter unit, reference numeral 15 reslurry unit, reference numeral 16 second filter unit, reference numeral 12 aqueous medium filtrate, reference numeral 19 wet polymerized toner (before being washed), reference numeral 18 wash medium, reference numeral 17 wet polymerized toner (washed), and reference numeral 20 reslurry.

Figure 5:
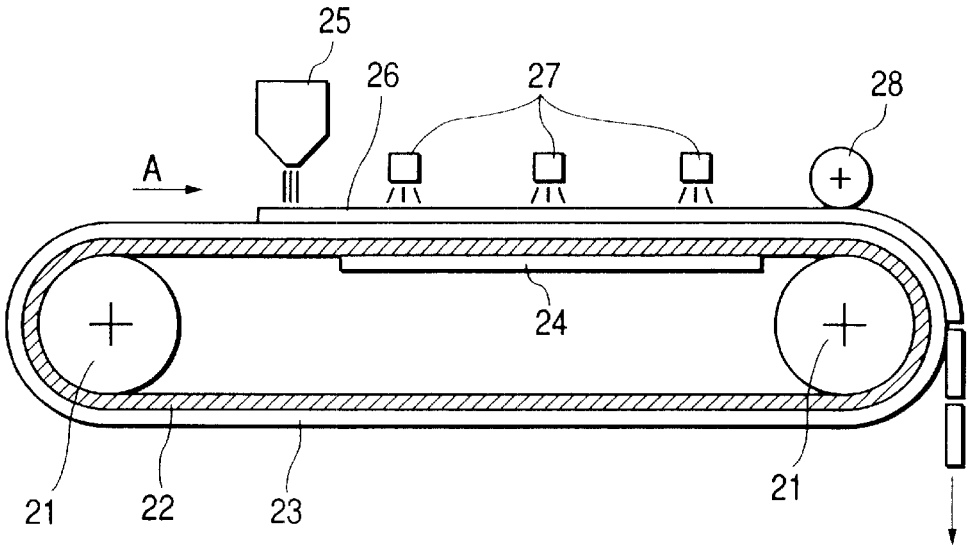
FIGS. 5 and 6 illustrate other types of filter units which can be used in combination with the decanter type centrifugal separator for the present invention.
Figure 6:
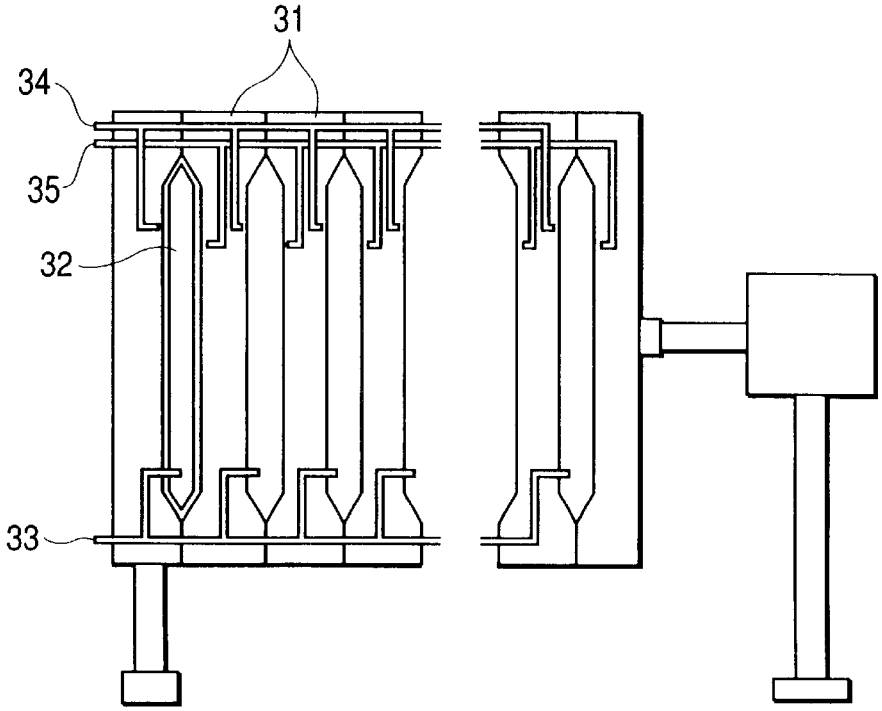

The slurry suspension 11, incorporated with an acid or alkali to dissolve the dispersion stabilizer therein, is subjected to the solid/liquid separation in the first filter unit 14, where it is separated into the aqueous medium filtrate 12 and wet toner 19 (before being washed). The wet toner 19 is washed with the wash medium 18 (e.g., water) by the reslurry unit 15, the wet toner 19 mixed with the wash medium 18 being referred to as the reslurry 20. The reslurry 20 is subjected to the solid/liquid separation in the second filter unit 16, where it is separated into the aqueous medium filtrate 12 and wet toner 17 (washed). In the process of the present invention, at least one of the first filter unit 14 and second filter unit 16 is preferably a decanter type centrifugal separator, more preferably the first filter unit 14 is, still more preferably both filter units 14 and 16 are decanter type centrifugal separators, for efficient removal of the dispersion stabilizer and increasing productivity. When one of the filter units 14 and 16 is a decanter type centrifugal separator, the other unit may be a conventional pressurized or vacuum filter unit. FIGS. 5 and 6 illustrate examples of vacuum filter unit (belt filter) and pressurized filter unit (filter press), respectively, suitably used in combination with a decanter type centrifugal separator for the present invention. Both belt filter and filter press use filter cloth as the filter for solid/liquid separation under vacuum and pressure, respectively.

FIG. 5 illustrates a simplified sectional view of a belt filter.

The drain screw belt type belt filter shown in FIG. 5, is equipped with 2 or more rolls 21, the endless drain screw belt 22 supported by the rolls 21 to be continuously driven in the arrowed direction A, filter cloth 23 positioned on the belt 22, and the vacuum tray 24 (one or divided into two or more parts) below the belt 22. The slurry suspension is sent downward onto the filter cloth 23 via the liquid supply port 25, and filtered and dehydrated under a vacuum. The filtrate is collected in the vacuum tray 24, from which it is sent to a vacuum tank (not shown) via a filtrate tube (also not shown). The cake 26, i.e., the solids separated by the filter, and the filter cloth 23 move together with the drain screw belt 22, during which a wash medium is sprayed from one or more cake washing unit 27 onto the running cake 26, to remove the soluble materials together with the filtrate. The dehydrated cake 26 is further dehydrated under pressure by the pressurizing unit 28, and separated off the filter cloth 23 by the radius provided by the rolls 21 or a discharge roll (not shown).

FIG. 6 illustrates a simplified sectional view of a filter press.

The slurry suspension is supplied into a filter chamber via the liquid supply port 33. The filtrate passing through the filter cloth 32 is discharged via the filtrate/wash water discharge port 34. The pressed cake may be washed, as required, with wash water, which is supplied from the filtrate/wash water discharge port 34 and via the filter cloth 32. The used wash water is discharged from the wash water discharge port 35. Then, the unit is ventilated using the port 34 or 35, the filter plates 31 are separated from each other, and the cake is discharged.

Both belt filter and filter press discharge the wet toner, separated from the medium by the solid/liquid separation step, in the form of cake, which must be broken up by an adequate step before being sent to the subsequent step.

The conventional process washes the cake by a combination of the filter units which use the above-described filter cloth or the like. Each filter unit breaks the cake as the essential step. Moreover, it needs washing of the filter, because the contaminated filter may deteriorate the toner quality. The present invention uses at least one, preferably a combination of two or more, decanter type centrifugal separators, which help simplify the toner production process and reduce filter washing load.

The reslurry unit 15 shown in FIG. 4 will be briefly described. The reslurry unit 15 is normally a tank-shaped unit with an agitator, and agitates the wet toner (before being washed) and wash medium (e.g., water) to redisperse the toner in the medium. The reslurry, after being subjected to the above step for a given period, is sent the second filter unit by an adequate liquid-pumping device, e.g., pump (not shown).

The process of the present invention adequately produces the colored resin particles, having a weight-average particle size of 3 to 10 $\mu$m and true specific gravity of 1.05 to 2.0. The clearance between the inner wall of the outer rotary cylinder and screw conveyor in the decanter type centrifugal separator is preferably set at 1 to 5 mm, especially for production of the particles having a weight-average particle size of 3 to 10 $\mu$m. These particles are prevented from deterioration very efficiently, and allow highly efficient filtration. The true specific gravity beyond the above range is undesirable. At below 1.05, they are difficult to separate from the medium by filtration. At above 2.0, on the other hand, they may be damaged during the centrifugal separation step, because of an excessive centrifugal force they are exposed to.

The toner produced by the process of the present invention is preferably incorporated with a compound having a low softening point as the releasing agent, to improve its fixing characteristics. This compound preferably has a maximum peak in a range from 40 to 90° C., determined in accordance with ASTM D3418-8. The maximum peak beyond the above range is undesirable. At below 40° C., the compound will have a weak self-agglomeration force, and hence insufficient offsetting characteristics at high temperature. At above 90° C., on the other hand, the compound needs a higher fixing temperature. In addition, when the toner is produced by the direct polymerization in an aqueous medium, where the granulation and polymerization are effected in the aqueous medium, the compound having a low softening point may separate out, particularly during the granulation step, deteriorating the suspension system.

The maximum peak temperature may be determined by an analyzer (e.g., Perkin Elmer DSC-7), where the melting points of indium and zinc are used for temperature correction for the detector, and heat of fusion of indium is used for adjustment of heating value. The sample is set in an aluminum pan, and heated at a temperature rise rate of 10° C./min together with an empty pan as a control.

The compounds of low softening point useful for the present invention include paraffin wax, polyolefin wax, Fischer-Tropsch wax, amide wax, higher fatty acid, ester wax, derivatives thereof, and graft/block compounds thereof.

The toner is preferably incorporated with 3 to 30% by weight of the compound of low softening point. At below 3% by weight, the toner will have insufficient fixing properties. At above 30% by weight, on the other hand, the toner particles tend to agglomerate with each other during the polymerization and granulation steps to have a wide size distribution. One of the concrete methods for incorporating the compound having a low softening point includes using the compound having a lower polarity than the main polymerizable monomer, incorporating a small quantity of resin or monomer having a high polarity in the monomer composition, and dispersing the monomer composition in an aqueous medium, thus having the toner particles of the so-called core/shell structure with the compound of low softening point being coated with the outer shell resin. The toner particle size distribution and size can be controlled by various methods, e.g., selecting types and quantities of an inorganic salt slightly soluble in water or a dispersant functioning as a protective colloid, controlling mechanical conditions (e.g., rotor speed, pass times, blade shape and other agitation conditions, vessel shape, etc.), and controlling solid concentration of the aqueous solution.

The concrete examples of the preferable polymerizable monomers for the present invention include styrene-type monomers, e.g., styrene, o-, m- and p-methyl styrene, and m- and p-ethyl styrene; (meth)acrylate-type monomers, e.g., methyl (meth)acrylate, ethyl (meth)acrylate, propyl (meth) acrylate, butyl (meth)acrylate, octyl (meth)acrylate, dodecyl (meth)acrylate, stearyl (meth)acrylate, behenyl (meth) acrylate, 2-ethyl hexyl (meth)acrylate, dimethylaminoethyl (meth)acrylate, and diethylaminoethyl (meth)acrylate; ene-type monomers, e.g., butadiene, isoprene and cyclohexene; and (meth)acrylonitrile and amide acrylate. They may be used individually or, generally, adequately mixed with polymerizable monomers to have a theoretical glass transition temperature (Tg) of 40 to 75° C. (refer to Polymer Handbook, 2nd edition, III-P139–192, John Wiley & Sons). At a theoretical glass transition temperature below 40° C., problems may occur in toner preservation stability and developer durability stability. At above 75° C., on the other hand, increased fixation temperature may result, which may cause various problems, e.g., insufficient mixing of toners different in color and poor color reproducibility in the case of full-color toner, and greatly deteriorated transparency of OHP images. These may be detrimental to high-quality images.

The resin component produced preferably has a number-average molecular weight (Mn) of 5,000 to 100,000, and a ratio of weight-average molecular weight (Mw) to number-average molecular weight (Mn), i.e., (Mw/Mn) ratio, of 2 to 100.

Molecular weight of the resin component is determined by gel permeation chromatography (GPC). More concretely, the toner is extracted with toluene as a solvent for 20 hours by a Soxhlet extractor beforehand, treated to distill off toluene by a rotary evaporator, thoroughly washed with an organic solvent, e.g., chloroform, which dissolves the compound of low softening point but cannot dissolve the outer shell resin, dissolved in tetrahydrofuran (THF), and filtered by a solvent-resistant membrane filter (pore size: 0.3 $\mu$m). The sample thus prepared is analyzed by a GPC analyzer (e.g., Waters 150C) with columns (e.g., Showa Denko A-801, 802, 803, 804, 805, 806 and 807 connected in series) to determine molecular weight distribution, with the calibration correlation prepared using the standard polystyrene resin.

When the toner having a core/shell structure is produced by the process of the present invention, it is particularly preferable to add further a polar resin to the outer shell resin, in order to incorporate the compound having a low softening point.

The polar resins useful for the present invention include copolymer of styrene and (meth)acrylic acid, copolymer of maleic acid, saturated polyester resin, and epoxy resin. It is particularly preferable that the polar resin does not contain in its molecule too many unsaturated groups which can react with the outer shell resin or the monomer. When the polar resin having many unsaturated groups is contained in the outer shell resin, it may crosslink with the monomer for the outer shell resin to produce a polymer having a very large molecular weight. In particular, this is undesirable for the full-color toner, e.g., color mixing of 4-color toner.

The toner produced by the process of the present invention may be coated further with a resin layer as the outermost shell.

The resin layer as the outermost shell is preferably designed to have a higher glass transition point than the resin layer as the outer shell, to further improve its resistance to blocking. It is also preferred that the outermost shell is crosslinked to an extent not to deteriorate fixing characteristics, and incorporated with a polar resin and charge-controlling agent, thus improving charging characteristics.

The method for providing the outermost shell layer is not limited, and some examples will be described below.

1. A monomer containing, as required, a polar resin, charge-controlling agent, crosslinking agent or the like dissolved or dispersed therein is added to the reaction system during the latter half or on completion of the polymerization step. After the above monomer is adsorbed by the polymerized toner particles, the polymerization is continued in the presence of a polymerization initiator.

2. Emulsion-polymerized particles or soap-free polymerized particles made from monomers containing, as required, a polar resin, charge-controlling agent, crosslinking agent or the like are added to the reaction system. These particles are agglomerated on the polymerized toner particle surfaces and fast attached thereto, e.g., under heating, as required.

3. Emulsion-polymerized particles or soap-free polymerized particles of monomers, dissolving or dispersing, as required, a polar resin, charge-controlling agent, crosslinking agent or the like are fast attached mechanically to the polymerized toner particle surfaces in a dry process.

The black colorants useful for the present invention include carbon black, magnetic materials, and materials adjusted to black with yellow, magenta and cyan colorants as described below.

The yellow colorants include such compounds as typified by condensed azo compounds, isoindolinone compounds, anthraquinone compounds, azo metal complexes, methine compounds and allylamide compounds. More concretely, they include C.I. Pigment Yellow 12, 13, 14, 15, 17, 62, 74, 83, 93, 94, 95, 109, 110, 111, 128, 129, 147 and 168.

The magenta colorants include condensed azo compounds, diketopyrrolopyrrole compounds, anthraquinone compounds, quinacridon compounds, basic dye lake compounds, naphthol compounds, benzimidazolone compounds, thioindigo compounds, and perylene compounds. More concretely, they include C.I. Pigment Red 2, 3, 5, 6, 7, 23, 48:2, 48:3, 48:4, 57:1, 81:1, 122, 144, 146, 166, 169, 177, 184, 185, 202, 206, 220, 221 and 254, as the particularly preferable ones.

The cyan colorants useful for the present invention include copper phthalocyanine compounds, their derivatives, anthraquinone compounds, and basic dye lake compounds. More concretely, they include C.I. Pigment blue 1, 7, 15, 15:1, 15:2, 15:3, 15:4, 60, 62 and 66, as the particularly preferable ones.

These colorants may be used individually, in combination, or in the form of solid solution.

The colorants for the present invention are selected according to their hue angle, color saturation, brightness, resistance to weather, OHP transparency, and dispersibility in the toner, in the case of color toners. They are normally incorporated at 1 to 20 parts by weight per 100 parts by weight of the polymerizable monomer.

When a magnetic material is used as the black colorant, it is incorporated at 4 to 150 parts by weight per 100 parts by weight of the polymerizable monomer, unlike the other types of colorants.

As the charge-controlling agent for the present invention, a known one may be used. For the color toners, it is preferably colorless, high in toner charging rate, and capable of keeping a certain charge quantity stably. More concretely, they include metallic compounds of salicylic acid, naphthoic acid and dicarboxylic acid, sulfonic acid, polymer type compounds with carboxylic acid in the side chain, boron compounds, urea compounds, silicon compounds and carixarene for the negative system; and quarternary ammonium salts, polymer type compounds with a quarternary ammonium salt in the side chain, guanidine compounds and imidazole compounds for the positive system, as the preferable ones. They are preferably incorporated at 0.5 to 10 parts by weight per 100 parts by weight of the polymerizable monomer.

The polymerization initiators useful for the present invention include azo-type initiators, e.g., 2,2'-azobis-(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile and azobisisobutyronitrile; and peroxide-type initiators, e.g., benzoyl peroxide, methylethylketone peroxide, diisopropyl peroxycarbonate, cumene hydroperoxide, 2,4-dichlorobenzoyl peroxide and lauroyl peroxide.

The polymerization initiator is normally incorporated at 0.5 to 20% by weight based on the polymerizable monomer, although varying depending on target degree of polymerization. Type of the initiator is selected by referring to 10 hour half-life temperature, while varying depending on target method of polymerization. These polymerization initiators may be used either individually or in combination.

A known additive, e.g., crosslinking agent, chain transfer agent or polymerization inhibitor, may be further added to control degree of polymerization.

The dispersion stabilizers useful for the present invention include, when suspension polymerization is employed, inorganic oxides, e.g., calcium triphosphate, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica, alumina, a magnetic material and ferrite; organic compounds, e.g., polyvinyl alcohol, gelatin, methyl cellulose, methylhydroxypropyl cellulose, ethyl cellulose, sodium salt of carboxymethyl cellulose and starch, which are dispersed in an aqueous phase and used. The dispersion stabilizer is preferably incorporated at 0.2 to 10.0 parts by weight per 100 parts by weight of the polymerizable monomer.

The commercial stabilizer may be directly used, and the inorganic compounds may be used which are prepared with agitation at high speed in a dispersion medium to form the dispersed particles of fine, uniform size. Taking tricalcium phosphate as an example, an aqueous solution of sodium phosphate is mixed with an aqueous solution of calcium chloride with vigorous agitation, thus producing the dispersion stabilizer suitable for suspension polymerization. These stabilizers may be incorporated with 0.001 to 0.1 parts by weight of a surfactant, to be further divided. More concretely, a commercial nonionic, anionic or cationic surfactant may be used. For example, sodium dodecyl sulfate, sodium tetradecyl sulfate, sodium pentadecyl sulfate, sodium octyl sulfate, sodium oleate, sodium laurate, potassium stearate and calcium oleate are preferably used.

The toner produced by the process of the present invention may be further incorporated with one or more external additives, to improve its functions.

The external additives include metal oxides, e.g., aluminum oxide, titanium oxide, strontium oxide, cerium oxide, magnesium oxide, chromium oxide, tin oxide and zinc oxide; nitrides, e.g., silicon nitride; carbides, e.g., silicon carbide; metallic salts, e.g., calcium sulfate, barium sulfate and calcium carbonate; metallic salts of fatty acids, e.g., zinc stearate and calcium stearate; and carbon black and silica.

These additives are incorporated at 0.01 to 10 parts by weight, preferably 0.05 to 5 parts by weight, per 100 parts by weight of the toner particles (colored resin particles). They may be used either individually or in combination. They are preferably treated to be hydrophobic beforehand.

Average particle size and size distribution of the colored resin particles may be determined by Coulter counter TA-II or Coulter multisizer II (Coulter). The electrolytic solution is an about 1% aqueous solution of NaCl (first grade).

For the analysis, 100 to 150 ml of the above aqueous electrolytic solution is incorporated with 0.1 to 5 ml of a surfactant (preferably an alkyl benzenesulfonate) and 2 to 20 mg of the sample. The electrolytic solution containing the sample suspended therein is treated with an ultrasonic disperser for about 1 to about 3 min. suspending the sample, and analyzed by the above analyzer (aperture size: 100 $\mu$m) for particle volumes and the number of particles, from which the volume distribution and number distribution are determined.

The weight-based weight-average particle size (D4) is determined from the above volume distribution, where a representative level at each channel is taken as the representative one for that channel.

For true specific gravity, the powder is pressed into a disk, whose weight and volume are measured to determine its specific gravity.

For moisture content, approximately 5 g of the moisture-containing sample is placed on an aluminum dish, accurately measured for its weight (A [g]), allowed to stand in a drier kept at 105° C. for 1 hour, and then accurately measured again for its weight after it is cooled (B [g]). Moisture content is determined by the following formula:

$$\text{Moisture content } (\%)=((A-B)/A)\times 100$$

EXAMPLES

The present invention is described more concretely by examples and comparative examples. In the following examples, Examples 1–6, 9 and 10 are Reference Examples which do not illustrate a second filtration step.

Example 1

A mixture of 700 parts by weight of ion-exchanged water and 450 parts by weight of 0.1 mol/l aqueous solution of $Na_3PO_4$ was heated at 60° C., and agitated at 4,500 rpm by CLEARMIX CLS-305 (M. TECHNIQUE Co., Ltd.), to which 68 parts by weight of 1.0 mol/l aqueous solution of $CaCl_2$ was slowly added to produce the aqueous medium containing calcium phosphate.

A composition of

| | |
|---|---|
| (Polymerizable monomer) | |
| Styrene | 170 parts by weight |
| n-butyl acrylate | 30 parts by weight |
| (Colorant) | |
| C.I. Pigment Blue 15:3 | 10 parts by weight |
| (Charge-controlling agent) | |
| Metallic compound of di-t-butyl salicylate | 2 parts by weight |
| (Polar resin) | |
| Saturated polyester (acid value: 10 mg-KOH/g, peak molecular weight: 8,500) | 15 parts by weight |
| (Releasing agent) | |
| Ester-type wax (melting point: 65° C.) | 40 parts by weight |

was heated at 60° C., and uniformly dissolved/dispersed, in which 8 parts by weight of 2,2'-azobis(2,4-dimethylvaleronitrile) was dissolved as the polymerization initiator, preparing the polymerizable monomer composition.

The above polymerizable monomer composition was poured into the above aqueous medium, and agitated at 4,500 rpm and 60° C. in a $N_2$ atmosphere for 15 min by CLEARMIX, thus granulating the polymerizable monomer composition.

It was heated to 70° C. with agitation by a paddle agitator for polymerization for 10 hours. On completion of the polymerization step, the resulting product was treated at 80° C. under vacuum to distill off the residual monomer, cooled, incorporated with hydrochloric acid to dissolve the calcium phosphate salt, and subjected to solid/liquid separation by a decanter type centrifugal separator of the structure shown in FIG. 1 in accordance with the flow diagram shown in FIG. 3.

The following filtration conditions were used: clearance between the inner wall of the outer rotary cylinder and screw conveyor: set at 1.5 mm; centrifugal force: 3,100 G set by controlling rotational speed of the outer rotary cylinder; differential rotational speed between the outer rotary cylinder and screw conveyor: 10 rpm; and slurry suspension feed rate: 100 l/hour, supplied by a constant-volume pump. The solid thus produced was in a moisture content of 25%.

The solid was then dried to produce the colored resin particles. They had a weight-average particle size of 7.0 $\mu$m, sharp size distribution, and true specific gravity of 1.10.

The particle surfaces showed no cracking or other damages, as observed by a scanning electron microscope.

The washed conditions of the colored resin particles were evaluated by measuring quantity of the dispersion stabilizer remaining in the colored resin particles. It was quantitatively measured by a fluorescence X-ray analyzer (RIX3000, manufactured by Rigaku Inc.). It is accepted that the residual dispersion stabilizer causes essentially no problems when its content is 500 ppm or less, but may influence charging characteristics of the toner when it exceeds 500 ppm. The resin particles prepared in this embodiment contained the residual dispersion stabilizer at an acceptable level of 280 ppm.

Hydrophobic silica (1.0 parts by weight) having a BET specific surface area of 200 $m^2/g$ was added to 100 parts by weight of the colored resin particles, to prepare the toner.

The toner image, evaluated by an analyzer (Canon Inc., modified LBP-2030), was good with high image concentration and controlled fogging.

Example 2

A toner was prepared in the same manner as in Example 1 except that the centrifugal force was set at 2,100 G for the filtration. The solid prepared by the filtration was in a moisture content of 31%.

It was then dried to produce the colored resin particles. They had a weight-average particle size of 7.2 $\mu$m, sharp size distribution, and true specific gravity of 1.10. The particle surfaces showed no cracking or other damages, as observed by a scanning electron microscope.

The washed conditions of the colored resin particles were good, because they contained the residual dispersion stabilizer at an acceptable level of 320 ppm.

Hydrophobic silica (1.0 parts by weight) having a BET specific surface area of 200 $m^2/g$ was added to 100 parts by weight of the colored resin particles, to prepare the toner.

The toner image, evaluated by the same method as that for Example 1, was good with high image concentration and controlled fogging.

Example 3

A toner was prepared in the same manner as in Example 1 except that the centrifugal force was set at 1,200 G for the filtration. The solid prepared by the filtration was in a moisture content of 40% showing a slight tendency to agglomere, and needed simple breaking-up to some extent.

It was then dried to produce the colored resin particles. They had a weight-average particle size of 7.3 $\mu$m, sharp size distribution, and true specific gravity of 1.10. The particle surfaces showed no cracking or other damages, as observed by a scanning electron microscope.

The washed conditions of the colored resin particles were good, because they contained the residual dispersion stabilizer at an acceptable level of 390 ppm.

Hydrophobic silica (1.0 parts by weight) having a BET specific surface area of 200 $m^2/g$ was added to 100 parts by weight of the colored resin particles, to prepare the toner.

The toner image, evaluated by the same method as that for Example 1, had a sufficient image concentration, although showing a little fogging.

Example 4

A toner was prepared in the same manner as in Example 1 except that the centrifugal force was set at 5,100 G for the filtration. The solid prepared by the filtration was in a moisture content of 12%.

It was then dried to produce the colored resin particles. They had a weight-average particle size of 6.9 $\mu$m, sharp size distribution, and true specific gravity of 1.10. The particle surfaces showed fine cracks, as observed by a scanning electron microscope.

The washed conditions of the colored resin particles were good, because they contained the residual dispersion stabilizer at an acceptable level of 250 ppm.

Hydrophobic silica (1.0 parts by weight) having a BET specific surface area of 200 $m^2/g$ was added to 100 parts by weight of the colored resin particles, to prepare the toner.

The toner image, evaluated by the same method as that for Example 1, had a high image concentration, although showing a little fogging.

Example 5

A mixture of 700 parts by weight of ion-exchanged water and 450 parts by weight of 0.1 mol/l aqueous solution of $Na_3PO_4$ was heated at 60° C., and agitated by a homomixer, to which 68 parts by weight of 1.0 mol/l aqueous solution of $CaCl_2$ was slowly added to produce the aqueous medium containing calcium phosphate.

A composition of

| | |
|---|---|
| Styrene | 80 parts by weight |
| N-butyl acrylate | 20 parts by weight |
| Unsaturated polyester resin | 2 parts by weight |
| Charge-controlling agent (Fe compound of monoazo dye type) | 4 parts by weight |
| Surface-treated hydrophobic magnetite | 100 parts by weight |

was uniformly dispersed and mixed by the use of an attritor (Mitsui Miike Kakoki), then heated at 60° C., and incorporated with 10 parts by weight of a low-molecular-weight polyethylene, in which 8 parts by weight of 2,2'-azobis(2,4-dimethylvaleronitrile) [$t_{1/2}$: 140 min. at 60° C.] and 2 parts by weight of dimethyl-2,2'-azobisisobutyrate [$t_{1/2}$: 270 min. at 60° C.; $t_{1/2}$: 80 min. at 80° C.] were dissolved as the polymerization initiators, preparing the polymerizable monomer composition.

The above polymerizable monomer composition was poured into the above aqueous medium, and the mixture was agitated at 10,000 rpm and 60° C. in a $N_2$ atmosphere for 15 min by a TK homomixer (Tokushu Kika Kogyo), thus granulating the polymerizable monomer composition. It was kept at 60° C. with agitation by a paddle agitator for polymerization for 1 hour, then heated to 80° C., and agitated for 10 hours. On completion of the polymerization step, the suspension was cooled, incorporated with hydrochloric acid to dissolve the calcium phosphate, and subjected to solid/liquid separation by a decanter type centrifugal separator of the structure shown in FIG. 1 in accordance with the flow diagram shown in FIG. 3.

The following filtration conditions were used: clearance between the inner wall of the outer rotary cylinder and screw conveyor: set at 1.5 mm; centrifugal force: 3,100 G set by controlling rotational speed of the outer rotary cylinder; differential rotational speed between the outer rotary cylinder and screw conveyor: 10 rpm; and slurry suspension feed rate: 300 l/hour, supplied by a constant-volume pump. The solid thus produced was in a moisture content of 19%.

The solid was then dried to produce the colored resin particles. Their surfaces showed no cracking or other damages, as observed by a scanning electron microscope.

The washed conditions of the colored resin particles, evaluated by the same method as that for Example 1, were very good, because they contained the residual dispersion stabilizer at a low level of 200 ppm.

The colored resin particles had a weight-average particle size of 7.5 $\mu$m, sharp size distribution, and true specific gravity of 1.78.

Hydrophobic silica (1.0 parts by weight) having a BET specific surface area of 200 $m^2/g$ was added to 100 parts by weight of the colored resin particles, to prepare the toner having sharp size distribution.

The toner image, evaluated by the same method as that for Example 1, was good with high image concentration and controlled fogging.

Example 6

A toner was prepared in the same manner as in Example 5 except that the centrifugal force was set at 2,100 G for the filtration. The solid prepared by the filtration was in a moisture content of 25%.

It was then dried to produce the colored resin particles. Their surfaces showed no cracking or other damages, as observed by a scanning electron microscope.

The washed conditions of the colored resin particles, evaluated by the same method as that for Example 1, were good, because they contained the residual dispersion stabilizer at an acceptable level of 250 ppm. They had a weight-average particle size of 7.7 μm, sharp size distribution, and true specific gravity of 1.78.

Hydrophobic silica (1.0 parts by weight) having a BET specific surface area of 200 $m^2/g$ was added to 100 parts by weight of the colored resin particles, to prepare the toner.

The toner image, evaluated by the same method as that for Example 1, was good with high image concentration and controlled fogging.

Example 7

The slurry suspension, prepared in the same manner as in Example 1, was filtered in accordance with the flow diagram shown in FIG. 4, where the decanter type centrifugal separator shown in FIG. 1 was used both for the first and second filter units. Ion-exchanged water was used as the wash medium (dispersion medium) at the time of reslurry.

No breaking-up step was needed in this embodiment for the wet toner discharged from the first and second filter units.

The decanter type centrifugal separators were operated under the same conditions as in Example 1 except that the centrifugal force was set at 2,100 G for the first filter unit and 3,100 G for the second filter unit. The first filter unit was operated at a lower centrifugal force, to keep the moisture content of the solid slightly higher, thereby making it more compatible with the wash medium at the time of reslurry.

The solid prepared by the filtration was in a moisture content of 22%.

No decline in through-put was observed, even when the solid/liquid separation was effected in a continuous batch manner, because no filter medium was used, making the production process more stable and producing no solid loss.

The washed conditions of the colored resin particles, evaluated by the same method as that for Example 1, were good, because they contained the residual dispersion stabilizer at a very low level of 150 ppm.

These particles were then dried. They had a weight-average particle size of 7.2 μm, sharp size distribution, and true specific gravity of 1.10.

The particle surfaces showed no cracking or other damages, as observed by a scanning electron microscope.

Hydrophobic silica (1.0 parts by weight) having a BET specific surface area of 200 $m^2/g$ was added to 100 parts by weight of the colored resin particles, to prepare the toner. The toner image, evaluated by the same method as that for Example 1, was good with high image concentration and controlled fogging.

Example 8

The slurry suspension, prepared in the same manner as in Example 5, was treated in the same manner as in Example 7 for washing and filtering the colored resin particles. No breaking-up step was needed also in this embodiment for the wet toner discharged from the first and second filter units.

The solid prepared by the filtration was in a moisture content of 17%.

No decline in through-put was observed, even when the solid/liquid separation was effected in a continuous batch manner, because no filter medium was used, making the production process more stable and producing no solid loss.

The washed conditions of the colored resin particles, evaluated by the same method as that for Example 1, were good, because they contained the residual dispersion stabilizer at an acceptable low level of 120 ppm.

The colored resin particles thus prepared had a weight-average particle size of 7.8 μm, sharp size distribution, and true specific gravity of 1.78.

The toner image, evaluated by the same method as that for Example 1, was good with high image concentration and controlled fogging.

Example 9

A toner was prepared in the same manner as in Example 1 except that the clearance between the inner wall of the outer rotary cylinder and screw conveyor was set at 0.7 mm. The solid prepared by the filtration was in a moisture content of 22%.

It was then dried to produce the colored resin particles. They had a weight-average particle size of 7.0 μm, sharp size distribution, and true specific gravity of 1.10. The particles had fine cracks on the surfaces, as observed by a scanning electron microscope, slightly damaging the toner particles.

The washed conditions of the colored resin particles were good, because they contained the residual dispersion stabilizer at an acceptable level of 260 ppm.

Hydrophobic silica (1.0 parts by weight) having a BET specific surface area of 200 $m^2/g$ was added to 100 parts by weight of the colored resin particles, to prepare the toner.

The toner image, evaluated by the same method as that for Example 1, was good with high image concentration and controlled fogging.

Example 10

A toner was prepared in the same manner as in Example 1 except that the clearance between the inner wall of the outer rotary cylinder and screw conveyor was set at 8 mm. The solid prepared by the filtration was in a moisture content of 30%.

It was then dried to produce the colored resin particles. They had a weight-average particle size of 6.9 μm, sharp size distribution, and true specific gravity of 1.10. The particle surfaces showed no cracking or other damages, as observed by a scanning electron microscope. However, the larger clearance caused the solids to remain slightly more in the decanter, decreasing the product yield to some extent. The washed conditions of the colored resin particles were good, because they contained the residual dispersion stabilizer at an acceptable level of 300 ppm.

Hydrophobic silica (1.0 parts by weight) having a BET specific surface area of 200 $m^2/g$ was added to 100 parts by weight of the colored resin particles, to prepare the toner.

The toner image, evaluated by the same method as that for Example 1, was good with high image concentration and controlled fogging.

Comparative Example 1

A toner was prepared in the same manner as in Example 1 except that the vacuum belt filter shown in FIG. 5 (Sumitomo Heavy Industries, EAGLE FILTER) was used. The solid prepared by the filtration was slightly thick, and had a moisture content of 54%.

The washed conditions of the colored resin particles were evaluated by the same method as that for Example 1. They were less washable than those prepared in Example 1, because of their higher residual dispersion stabilizer content of 650 ppm.

Filter cloth was used repeatedly as the filter, and 10% of the solid remained on the filter cloth. Although the filtration step proceeded smoothly at the initial stage without showing clogging, the through-put tended to decrease as clogging was gradually brought out.

The solid was deposited on the walls of the piping system by which it was sent to the subsequent drying step. It was then dried to produce the colored resin particles. They had a weight-average particle size of 8.0 $\mu$m, but some were coarse. Hydrophobic silica (1.0 parts by weight) having a BET specific surface area of 200 $m^2/g$ was added to 100 parts by weight of the colored resin particles, to prepare the toner.

The toner image was evaluated by the same method as that for Example 1. It had a lower image concentration than that prepared in Example 1, and showed fogging.

Comparative Example 2

A toner was prepared in the same manner as in Example 5 except that the vacuum belt filter shown in FIG. 5 (Sumitomo Heavy Industries, EAGLE FILTER) was used. The solid prepared by the filtration was in the form of cake, and had a moisture content of 25%. The cake was cracked, suggesting insufficient washing.

The washed conditions of the colored resin particles were evaluated by the same method as that for Example 5. They were apparently less washable than those prepared in Example 5, because of their higher residual dispersion stabilizer content of 570 ppm.

Filter cloth was used repeatedly as the filter, and 2% of the cake-like solid remained on the filter cloth. Although the filtration step proceeded smoothly at the initial stage without showing clogging, through-put tended to decrease as clogging was gradually brought out.

The breaking-up step was necessary to send the cake-like solid to the subsequent drying step. It was then dried to produce the colored resin particles. They had a weight-average particle size of 8.2 $\mu$m, but some were coarse.

No damage was observed on the particle surfaces by a scanning electron microscope.

Hydrophobic silica (1.0 parts by weight) having a BET specific surface area of 200 $m^2/g$ was added to 100 parts by weight of the colored resin particles, to prepare the toner.

The toner image was evaluated by the same method as that for Example 1. It had a lower image concentration than that prepared in Example 1, and showed fogging.

Comparative Example 3

The slurry suspension, prepared in the same manner as in Example 1, was filtered in accordance with the flow diagram shown in FIG. 4, where the vacuum belt filter shown in FIG. 5 (Sumitomo Heavy Industries, EAGLE FILTER) was used as the first filter unit and the filter press shown in FIG. 6 was used as the second filter unit.

The slurry suspension was sent to the belt filter as the first filter unit, where it was subjected to the solid/liquid separation. The solid discharged from the belt filter was broken up by a breaking unit, and then poured into a reslurry tank containing beforehand ion-exchanged water as the wash medium. The broken wet toner was thoroughly agitated in the above tank for reslurrying. On completion of this step, the reslurry liquid is sent to the filter press as the second filter unit, where it was subjected to the solid/liquid separation, to produce the wet toner solid.

The solid prepared by the filtration was in a moisture content of 23%.

The washed conditions of the colored resin particles, evaluated by the same method as that for Example 1, were good, because they contained the residual dispersion stabilizer at an acceptable level of 250 ppm. However, 8% of the solid remained on the filter cloth of each filter unit. Moreover, through-put tended to decrease, resulting from clogging of the cloth occurring gradually with time.

The cake-like solid was broken up and dried by a drier, to produce the colored resin particles. They had a weight-average particle size of 8.2 $\mu$m and a true specific gravity of 1.10.

Hydrophobic silica (1.0 parts by weight) having a BET specific surface area of 200 $m^2/g$ was added to 100 parts by weight of the colored resin particles, to prepare the toner.

The toner image was evaluated by the same method as that for Example 1. It had a lower image concentration than that prepared in Example 1, and showed fogging.

What is claimed is:

1. A process of producing a polymerized toner, comprising polymerizing a polymerizable monomer composition containing at least a polymerizable monomer and colorant in a medium containing a dispersion stabilizer to produce colored resin particles, adding acid or alkali to the medium to dissolve the dispersion stabilizer, separating the colored resin particles from the medium by a first filtration, washing the separated colored resin particles with a washing liquid, separating the washed colored resin particles from the washing liquid by a second filtration and drying said particles, wherein the first filtration is conducted by (a) supplying a feed solution comprising the colored resin particles and the medium to an outer rotary cylinder of a decanter centrifugal separator having said outer rotary cylinder which contains a screw conveyor freely rotating relative to said outer rotary cylinder and (b) regulating centrifugal force generated by said outer rotary cylinder to from 1,000 G to 5,000 G.

2. The process according to claim 1, wherein said washing step is effected in an aqueous dispersion medium.

3. The process according to claim 1, wherein the centrifugal force generated by the outer rotary cylinder of said decanter centrifugal separator is regulated in a range from 1,500 G to 4,000 G.

4. The process according to claim 1, wherein said colored resin particles have a weight-average particle size of 3 to 10 $\mu$m and a true specific gravity of 1.05 to 2.0.

5. The process according to claim 1, wherein the clearance between the inner wall of said outer rotary cylinder and said screw conveyor is set at 1 to 5 mm.

6. The process according to claim 1, wherein the clearance between the inner wall of said outer rotary cylinder and said screw conveyor is set at 1 to 2 mm.

7. The process according to claim 1, wherein the dispersion stabilizer is calcium phosphate.

* * * * *